US006685273B1

(12) United States Patent
Sollami

(10) Patent No.: US 6,685,273 B1
(45) Date of Patent: Feb. 3, 2004

(54) STREAMLINING BIT ASSEMBLIES FOR ROAD MILLING, MINING AND TRENCHING EQUIPMENT

(75) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 97 days.

(21) Appl. No.: 09/825,601

(22) Filed: Apr. 4, 2001

Related U.S. Application Data

(63) Continuation-in-part of application No. 09/500,983, filed on Feb. 15, 2000, now Pat. No. 6,371,567.

(51) Int. Cl.[7] ..... E21C 35/18

(52) U.S. Cl. ..... 299/106; 299/102; 299/104; 299/110

(58) Field of Search ..... 299/102–107, 299/110–111

(56) References Cited

U.S. PATENT DOCUMENTS 3,498,677 A * 3/1970 Morrow ..... 299/102
4,337,980 A * 7/1982 Krekeler ..... 299/102
4,621,871 A * 11/1986 Salani ..... 299/107
4,915,455 A 4/1990 O'Neill
5,106,166 A 4/1992 O'Neill
5,374,111 A 12/1994 Den Besten
D420,013 S 2/2000 Warren
6,086,160 A * 7/2000 Bitelli ..... 299/104

* cited by examiner

*Primary Examiner*—Heather Shackelford
*Assistant Examiner*—Sunil Singh
(74) *Attorney, Agent, or Firm*—Patnaude & Videbeck

(57) ABSTRACT

An improved bit assembly for road milling, mining, and trenching equipment includes a streamlined tip assembly that is a combination of conical and cylindrical in shape and devoid of protrusions or annular indentations that might impede the flow of removed material over and around the bit assembly or provide space for removed material to become clogged or imbedded on the tip assembly. The portion of the bit block which mounts on a drum or endless chain extends from a cylindrical portion of the bit block and provides opposed angled shoulders which extend downwardly and away from a central ridge on the bit block to again provide for efficient flow of removed material over and around the bit block.

4 Claims, 5 Drawing Sheets

STREAMLINING BIT ASSEMBLIES FOR ROAD MILLING, MINING AND TRENCHING EQUIPMENT

This is a continuation-in-part of Ser. No. 09/500,983 filed Feb. 15, 2000, now U.S. Pat. No. 6,371,567.

This invention relates generally to road surface removal or reclaimer-stabilizer equipment and mining equipment and more particularly to bit assemblies including bits, bit holders and bit blocks that are more efficient in their cutting and passage of the cut material around the bit assembly.

BACKGROUND OF THE INVENTION

Bit assemblies are utilized in road, off-road and mining machinery on the perimeter and across the width of a rotary drum or on the outside of a continuous chain or the like where the bits are moved through an orbit which is intercepted by the face of the material being removed or recycled. Road milling equipment removes the defective surface of a road and smoothes the top of all or selected portions of the road surface. The bits utilized include a tip and a shank. The shank is received and may axially rotate in a bit holder which is secured onto a bit block that, in turn, is mounted on the drum. Each of the bits has a hardened tip, preferably made of tungsten carbide or such other hardened material that acts to remove a portion of the surface it contacts. By using a sufficient number of these bits around the outer surface of a rotating drum, a large amount of surface may be worked.

The bit assembly including the bit, bit holder and bit block, act on the portion of the surface it is removing to separate that surface from the underlayment and as the drum rotates, passed that surface over the outside of the bit assembly. The milling of concrete and macadam surfaces required a substantial power output to operate the drum or continuous chain or the like. With the use of such a substantial power output to operate the heavy milling machinery, a need has developed to provide a more efficient bit assembly that utilizes less power to perform the same function as machines fitted with prior art bit assemblies.

In O'Neill et al, U.S. Pat. No. 4,915,455, a substantially frustoconical bit is mounted upon a block that provides a large mostly flat forward leading surface that impedes the flow of macadam or concrete therearound and provides a barrier to movement of the bit on additional portions of the surface to be milled.

Additionally, a need has developed for providing ease of removability of bit holders in their bit blocks, especially when portions of or all of the assembly becomes worn and in need of replacement. U.S. Pat. No. 5,374,111 discloses an undercut flange at the bottom of a base of a bit that allows a pry bar to be wedged between that flange and the top of the bit block to help remove a bit from the bit block. It would be desirable to provide more efficient means and multiple means for allowing the removal of a bit holder from a bit block. Additionally, heretofore known bit holders have been retained in bit blocks by the use of threaded nuts or retainer rings. A need has developed to provide means to mount the shank portion of a bit holder in a bit block without the need of a fastener on the distal end of the bit holder shank to retain same in the bit block.

Further, a need has developed for a truly quick-change type of bit holder that may easily and quickly be inserted in the bit block and removed therefrom.

It is, therefore, an object of the present invention, generally stated, to provide an improved means for quickly mounting and/or removing a bit holder from its associated bit block.

Another object of the present invention is the provision of a more efficient bit assembly that requires less power to run when mounted on road milling equipment than heretofore known bit assemblies while providing longer lasting useful life of operation.

A further object of the present invention is the provision of multiple means for retaining a bit holder in a bit block by means of a resilient interference fit between the holder and the block.

Another object of the present invention is the provision of an easily mounted tool on the bit holder that facilitates the removal of the bit holder from the bit block at the front of the leading surface of the bit holder without the need for a large amount of access to the rear of the bit block.

BRIEF DESCRIPTION OF THE DRAWINGS

The features of the present invention which are believed to be novel are set forth with particularity in the attached claims. The invention may best be understood by reference to the following description taken in conjunction with the accompanying drawings in which like numerals refer to like parts and in which:

Referring to FIG. 1, a bit, bit holder and bit block assembly, generally indicated at 15, constructed in accordance with the present invention, includes a bit, generally indicated at 16 and a spacer, generally indicated at 17, together with a bit holder, generally indicated at 18 and a bit block, generally indicated at 20.

Figure 1:
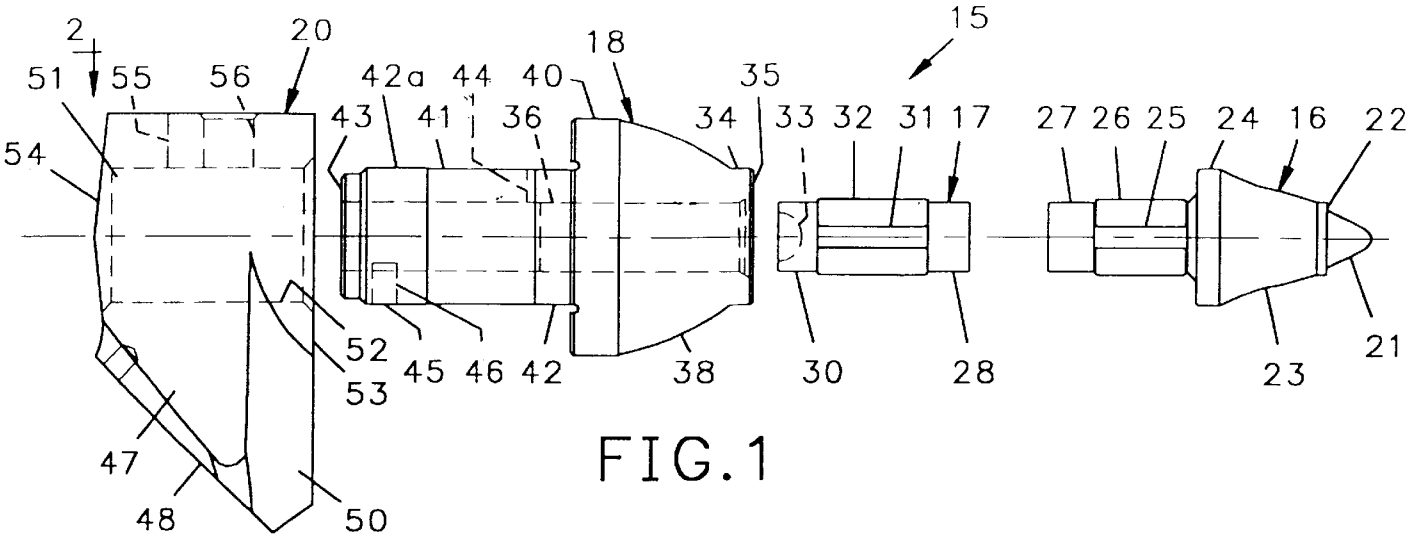
FIG. 1 is a side elevational exploded view of a bit assembly constructed in accordance with the present invention.

The bit 16 includes a hardened tip 21, usually made of tungsten carbide. The base of tungsten carbide tip 21 (not shown) resides in a pocket (not shown) in the front face 22 of a frustoconical forward portion 23 of bit 16. At the rear of the frustoconical portion 23 is a cylindrical front portion base 24. In this embodiment, the cylindrical base 24 performs a function which is analogous to prior art known as a "tire portion" of the bit because in that prior art the outside of the base portion has a rounded shape similar to the outside of a donut or tire. Aft of the cylindrical base 24, the tip narrows to a cylindrical shank 25, which, in this embodiment, includes a C-shaped retainer 26 therearound and a cylindrical shank portion base 27 defining the rear end of the bit.

The spacer 17 is shaped similarly to the shank portion 25–27 of bit 16 in that it includes opposed cylindrical ends 28, 30 and a slightly narrowed cylindrical shank portion 31 mounted therebetween having a C-shaped retainer 32 positioned therearound. At the outside of the opposed cylindrical end 30 is a spherical indent 33 whose purpose will be discussed in more detail below.

In this embodiment of the present invention, the bit holder, generally indicated at 18, is termed a bulbous shaped bit holder as the front generally conical portion includes a middle section having a convex outline. The leading portion of the generally conical front section of bit holder 18 includes a cylindrical nose 34, having a flat annular face 35 from which a central bore 36 extends axially all the way through the bit holder. Rearwardly adjacent the nose 34 is the bulbous portion 38 of the generally frustoconical front section of the bit holder 18. Rearwardly of the bulbous section 38 is the cylindrical base 40 which performs a similar function in the bit holder 18 that the cylindrical base 24 performs in the bit 16.

Aft of the base 40 of the conical front portion of bit holder 18 is the shank 41. The shank portion 41 includes an upper shoulder 42 which is slightly larger diameter than the middle shank portion 41, and a second enlarged portion 42 of shank 41 immediately adjacent the distal end 43 thereof. A slot, whose forward end is indicated at 44 extends from the end of upper shoulder portion 32 through the distal end 43 of the shank 41 thus providing a C-shape for the perimeter of the shank 41 allowing it to expand and contract diametrically for a force fit into the bit block, generally indicated at 20. A pin 45 is mounted in a bore 46 180 degrees around shank 41 from the slot 44. The pin 45 assures that the spacer 17 will not fall out of the bottom of bit holder bore 36 in the bit holder 18 when it is mounted therein.

In another important aspect of the present invention, the bit block 20 includes a base mounting portion 47 having a base 48 which is mountable on the outside of a drum (not shown) which is a part of road milling equipment. The front or leading portion of the mounting section 47 includes a pair of rearwardly angled shoulders 50—50 (only one shown). Adjacent the mounting section 47 which holds the bit block on the drum is a generally annular cylindrical bit holder mounting portion 51 having a central bore 52 positioned therethrough from a top surface 53 to a bottom distal portion 54 of the bit block 20. Adjacent the bottom portion 54 and opposite the mounting portion 47 is a slot 55 which increases the accessibility of a tool to the rear of the bit block and into the bore 52 of the bit block 20 at the rear 54 thereof. Also, immediately above slot 55 is a cylindrical bore 56 which may have a pin (shown in FIGS. 3 and 5 at 56*a*). Pin 56 extends into the slot 44 of the bit holder, thus preventing rotation of same when mounted in the bit block. As is evident from the exploded view, the shank portion 41 of the bit holder 18 is press fit into the bore 52 of the bit block 20 and retained therein. Further, the spacer 17 and the shank portion 25 of bit 16 are mountable through the front end 35 of the bit holder 18 and are retained therein by C-shaped retainers 26 and 32. Additionally, the spacer is retained in its mounted position by in 45.

Figure 2:
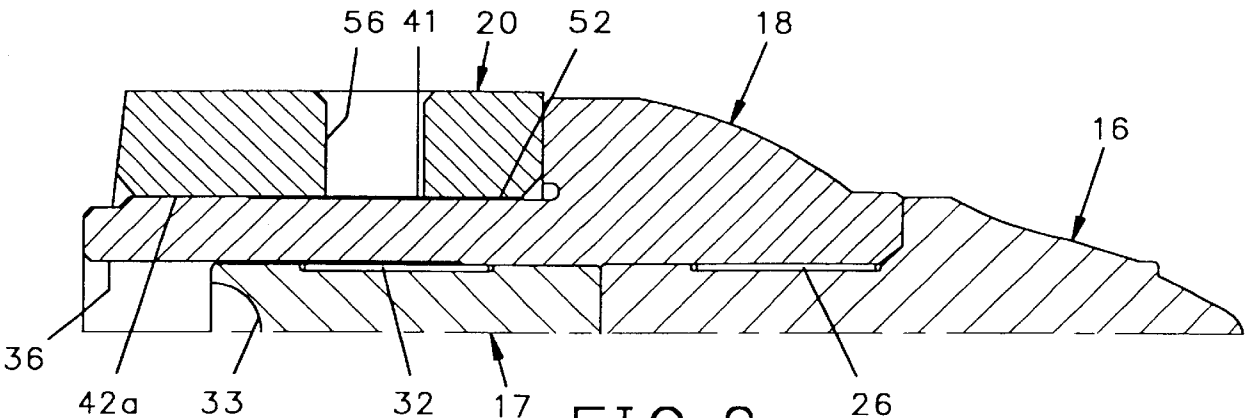
FIG. 2 is a fragmentary cross-sectional view with certain modifications taken substantially along line 2—2 of FIG. 1 with the items of FIG. 1 shown in mounted position on each other.

Referring to FIG. 2, the mounting relation between the bit block 20, bit holder 18, spacer 19 and bit 16 is shown in cross section. FIG. 2 is modified from a straight cross section of the assembly as shown in FIG. 1 in that the slot 44 of bit holder 18 and the slot 55 of bit block 20 are not seen so that the mounting relation between the bit block and bit holder may be shown in more detail. Additionally, the upper shoulder 42 of the bit holder is not shown so that the relationship between the lower shoulder 42*a* and the bit block bore 52 may be shown.

As is shown most clearly in FIG. 2, the lower raised shoulder 42*a* of the shank portion 41 of the bit holder 18 is press fit into the bore 52 of bit block 20. The press fit between the two is on the order of four times the ordinary press fit between a cylindrical male member and an annular bore because the C-shape cross section of the shank is resilient with the addition of slot 44 therein. This allows the lower shoulder 42*a* to be positioned in bore 52 with such a substantial press fit that neither a retaining nut nor retaining ring is necessary to maintain the bit holder in the bit block. However, because of vibration and potential rotation of the bit holder in the bit block, a pin 56*a* (FIG. 5) is mounted through bore 56 into the slot 44 (FIG. 1) of the bit holder shank in order to maintain the bit holder and bit block in correct non-rotating mounted orientation. As additionally shown in FIG. 2, the bit 16 and spacer 17 are mounted in the central bore 36 of bit holder 18 and retained therein by C-shaped retainer clips 26 and 32. As shown most clearly in FIG. 2, the semi-cylindrical indent 33 in the spacer 17 provides for the insertion of a tool through the backside of bore 36 which will accommodate punching out the spacer 17 and the bit 16 from the back of the assembly.

As also shown most clearly in FIG. 2, in an important aspect of the present invention, the profile of the bit, bit holder and bit block maintains either a cylindrical outline or a conical outline although the conical outline may be slightly concave or convex also, to provide a smooth efficient aerodynamic outer surface which in this case does not have air passing by it, but has macadam or concrete passing by it. This smooth outer surface of the bit 16, bit holder 18 and bit block 20 also benefits from the opposed shoulders 50 at the leading surface of the bit block 20. The aim in providing this efficient aerodynamic profile is to both provide longer life for the assembly and the portions thereof, and to provide for more efficient separation of the macadam or concrete and passage of same by the assembly, thus requiring less power to run the road milling equipment and also providing longer life for the assembly 15 when performing its function. Generally, the lack of sharp edges and the lack of cylindrical outcroppings along the surface, or indents along the surface, provide fewer areas for macadam or concrete to sharply impact the surface or become imbedded thereon, thus assuring a more efficient and longer work life for the assembly 15 and the parts thereof.

In operation, prior art road milling bit, bit holder and bit block assemblies normally operate for between three and four hundred hours before the parts wear out or a failure occurs in at least one part of the assembly. Applicant's bit, bit holder and bit block assembly have been operated for more than 1000 hours without serious deterioration of the assembly or failure of parts thereof. Also, the use of the assembly 15 of the present invention on road milling equipment has provided a milling system which consumes less gasoline per hour to operate. While gas consumption of the road milling equipment varies depending on depth of cut, temperature, surface to be milled, etc., over a long period of time, it is believed that the bit assembly of the invention yields about a 10 percent improvement over prior art bit assemblies.

Referring to FIGS. 3–6, a second embodiment of the present invention is shown utilizing the bit block 20 of the first embodiment together with a concave style bit holder, generally indicated at 60. Bit holder 60 differs from bit holder 18 not only in that it is concave in its conical leading portion, but also because it has a hardened annular insert 61 preferably made of tungsten carbide positioned at its leading surface. Since the hardened insert 61 extends towards the outside of the concave, but generally conical forward surface 62 of the front portion of bit holder 60 to provide structural strength, there are no notches in the concave surface 62. With this embodiment, the bit 16 (not shown) would be driven out of the bit holder 60 for replacement by inserting a rod to tool (not shown) in the bottom of bore 63 of the bit holder (shown most clearly in FIG. 3) until it is stopped by semi-spherical indent 33 of spacer 17 (FIG. 2) where a hammer struck on the end of the tool will drive the bit 16 outwardly of the bit holder 60. The use of a hardened insert 61 has been shown to increase the work life of the bit holder 60 by providing a tougher mounting for the bit 16 in the bit holder 60.

Figures 3, 4, 5, 6:
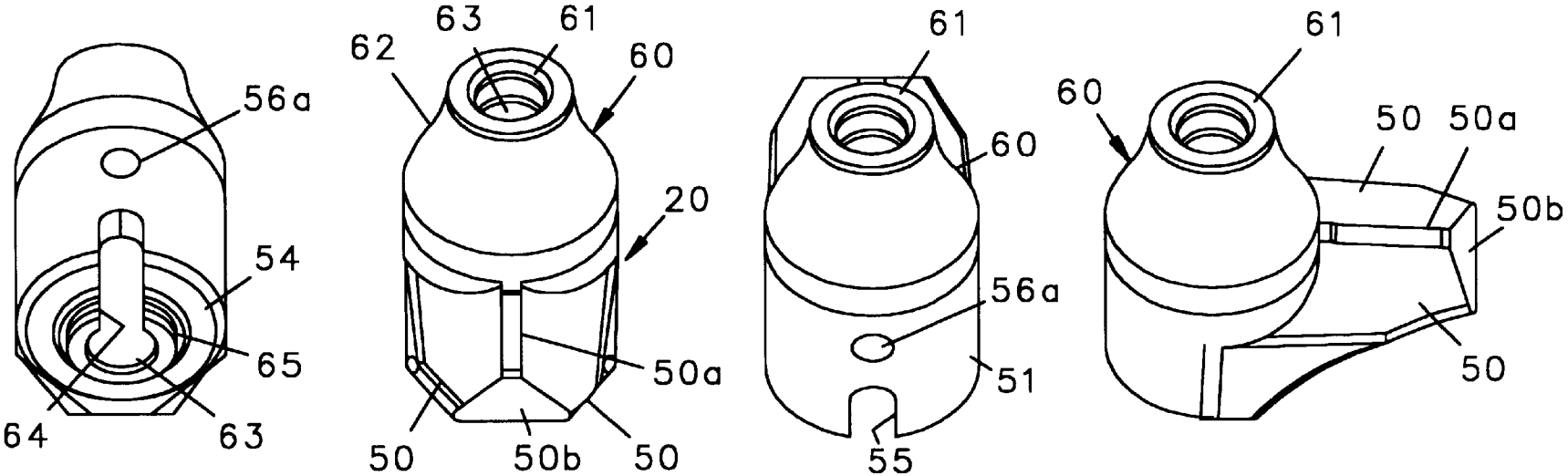
FIG. 3 is a bottom ¾ perspective view of a second embodiment of the invention showing a bit holder mounted in a bit block.
FIG. 4 is a top ¾ end perspective view of the second embodiment of the present invention.
FIG. 5 is a front ¾ perspective view of the second embodiment of the present invention.
FIG. 6 is an upper side perspective view of the second embodiment of the present invention.

FIGS. 4 and 6 tend to show the increased efficiency obtained by utilizing opposed shoulders 50—50 to direct macadam away from the forward portion 50*a* and third shoulder 50*b* of the bit block mounting portion. Also, as mentioned previously, and shown in FIGS. 3 and 5, the pin 56*a* is aligned with the slot 64 in the shank of bit holder 60 to prevent rotation of the bit holder 60 in the bit block 20 when mounted therein. Additionally, FIG. 3 shows the accessibility of the shank 65 on bit holder 60 through the rear 54 of the bit block 20. Shown most clearly in FIGS. 3–6, the forward facing surfaces of the bit holder 60 and bit block 20, with the exception of leading surface 50*a* for strength of part reasons, all extend rearwardly and outwardly to provide a smooth, efficient deflecting surface for material separated from the macadam or concrete by the bit 16.

Figure 9:
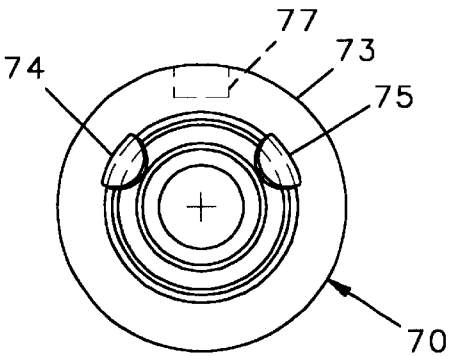
FIG. 9 is a front end elevational view of the third embodiment of the bit holder of the present invention.
Figure 7:
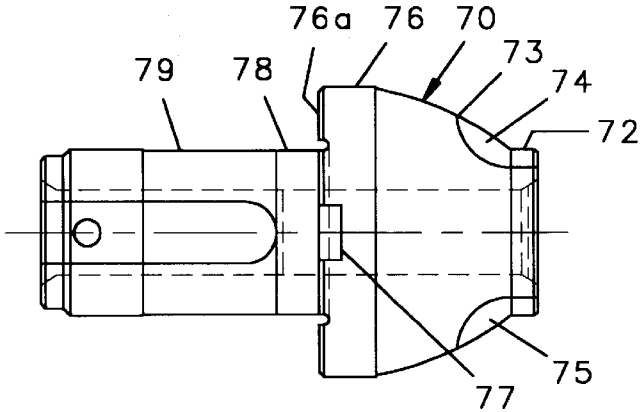
FIG. 7 is a top plan view of a third embodiment of a bit holder of the present invention.
Figure 8:
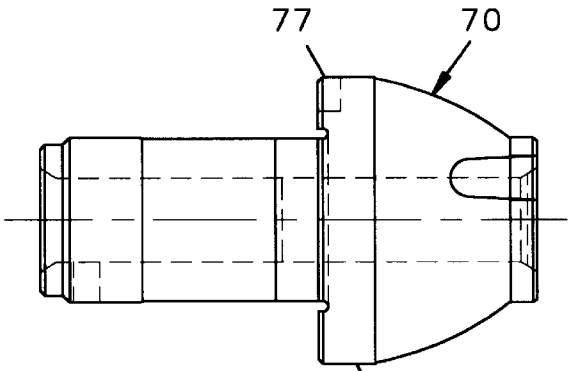
FIG. 8 is a side elevational view of the third embodiment bit holder of the present invention.

Referring to FIGS. 7, 8 and 9, a third embodiment of a bit holder is shown generally at 70. Bit holder 70 is similar to the bit holder 18 in that it is a steel front bulbous type having a slotted shank. The steel cylindrical flange front 71 includes an annular steel face 72 similar to the first embodiment. The bulbous frustoconical portion 73 extends rearwardly beyond the cylindrical nose and includes a pair of notches 74, 75 therein that provide tool access to the back of a bit for easing removal of the bit from the bit holder.

At the rear of the bulbous frustoconical portion 73 is the cylindrical base 75. In one important aspect of the present invention, the base 76 includes a rectangular notch 77 that extends radially inwardly from the outside of the circumference of cylindrical base 76 and is also in communication with the back face 76*a* of the cylindrical base. When the bit holder 70 is mounted in the bit block, such as 20, notch 77 will allow access of a tool therein to provide a prying method for removing the bit holder from the bit block. This is especially important if, for some reason, access to the back of the bit holder is not obtainable. A prying tool positioned in notch 77 would provide for removal of the bit holder out of the bit block until after the upper shoulder 78 of shank portion 79 is free of the top of the bit block, thus easing removal of the bit holder from the bit block.

Figure 11:
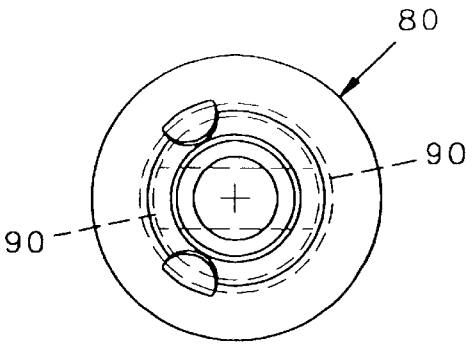
FIG. 11 is a front end elevational view of the fourth embodiment of a bit holder of the present invention.
Figure 10:
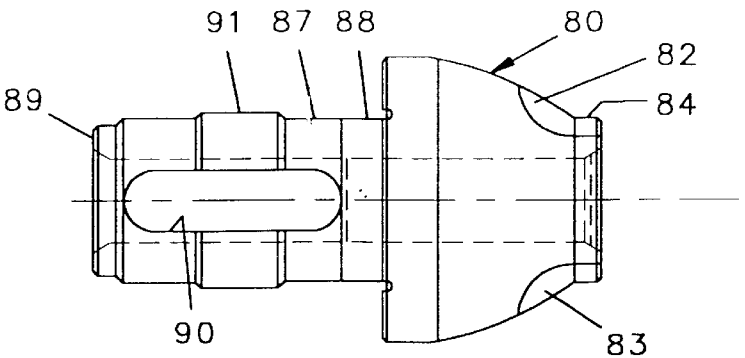
FIG. 10 is a top plan view of a fourth embodiment of a bit holder of the present invention.

Referring to FIGS. 10 and 11, a fourth embodiment of the bit holder of the present invention, generally indicated at 80 is a steel nosed bit holder similar to that shown in FIG. 1, i.e., a bulbous style frustoconical nose bit holder, with the exception that the notches 82, 83 are round in outline rather than rectangular as shown in the first embodiment 18. The frustoconical portion at the front of the bit holder 80 includes the cylindrical nose 84, bulbous frustoconical portion 85 and cylindrical base 86. Rearwardly of the base, the shank portion 87 includes an upper shoulder 88 similar to that shown in the first embodiment. However, the remainder of shank 87 differs from the shank 41 of the first embodiment in two ways. First, instead of having a slot extending from the edge of upper shoulder 88 to the distal end 89 of the shank, the fourth embodiment of the present invention includes a pair of diametrically opposed slots 90 from the upper shoulder 88 to the forward edge of the distal end 89 such that the distal end 89 is still annular in shape rather than C-shaped as in the first embodiment 18. The second difference in the shank portion between the first embodiment and the fourth embodiment, is that the lower shoulder portion 91 is moved forwardly on the shank to be at a position to bisect the opposed slots 90. In this embodiment, the pair of opposed slots take away stiffness from the annular shank such that the lower shoulder portions 91 are resilient similar to the lower shoulder portion 42*a* of the first embodiment even though the distal end 89 of the shank is continuously circular or annular in shape. The press fit of the lower shoulder 91 in the bore 52 of the bit block 20 is similar to that of the lower shoulder 42*a* of the bit holder 18 in that it is a greater interference fit than that found in typical male-female member press fits, thus providing for ease of secure mountability of the bit holder 80 in the bore 52 of bit block 20. As with the other embodiments, no nut or retainer is necessary to hold the bit holder in the bit block. Also, pin 56*a* fits in either of the slots 90—90.

Figure 12:
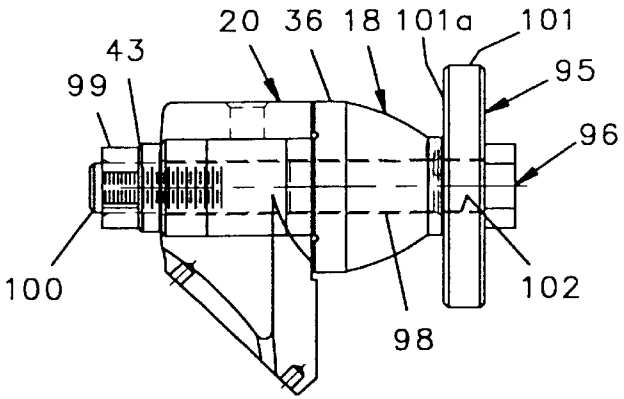
FIG. 12 is a side elevational view of a tool to facilitate removal of a bit holder from a bit block.

Referring to FIG. 12, a tool for aiding removal of the bit older 18 from the bit block 20 is generally indicated at 90. Tool 90 includes an elongate bolt 91 having a hex head 92, a shank 93 that extends through the bore 36 of the bit holder 18 and out the distal end 43 thereof where a hex head nut 94 may be turned on the threads 95 at the distal end of the shank portion 93 of bolt 91. An enlarged radially extending flange 96 has a central bore 97 through which the bolt shank 93 is passed prior to inserting the bolt through the bit holder bore 36. The large flat surface 96*a* on the rearward side of annular flange 96 provides ample room for positioning the tool thereagainst or striking a hammer thereto to remove the bit holder 18 from the bit block 20 without needing a large amount of access to the rear of the bit block 20 other than room to fit nut 99.

Figure 13:
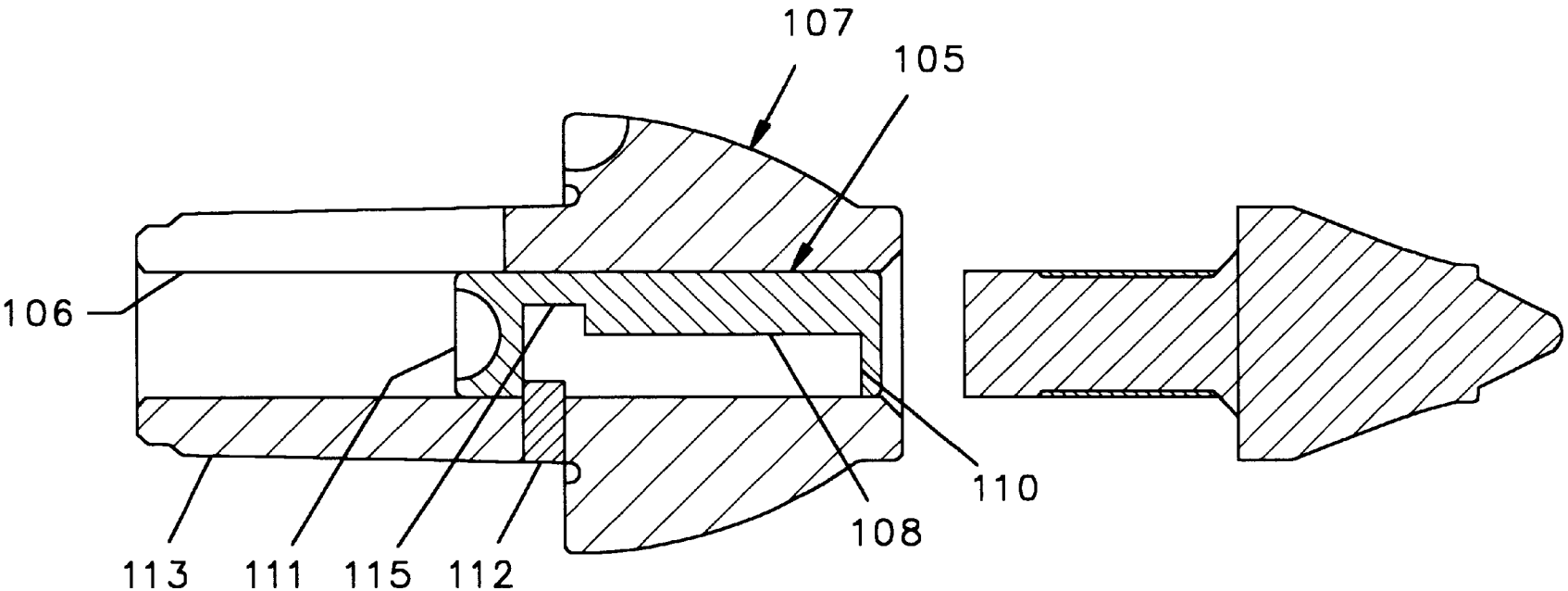
FIG. 13 is a cross-sectional view similar to FIG. 2 showing a second embodiment of the plunger of FIG. 1.

Referring to FIG. 13, a second embodiment of spacer or plunger, generally indicated at 105, performs the same function as spacer 17, is cylindrical in outline and slidingly fits in the central bore 106 of bit holder 107. Spacer of plunger 105 includes an elongate infernal slot 108 extending mediate the front end 110 and rear cupped end 111 thereof. A perpendicular bore 112 radially through the shank sidewall 113 secures a pin 114 that extends into slot 108 to limit the movement of the spacer in the bore. An additional notch 115 in spacer 105 provides for removing the spacer from the bit holder 107 by driving the pin into the notch. Unlike spacer 17, spacer 105 does not need a retainer 32 to keep it mounted in its respective bit holder bore. Thus, an improved road milling bit assembly spacer, bit holder and bit block have been shown and described together with three additional embodiments of the bit holder and a bit holder removing tool. The bit assembly in being efficiently smooth and lacking in substantial annular discontinuities around the bit provides an efficiency of use when the bit separates either macadam or concrete and also provides for an efficient passage of such material around the bit assembly that lessens wear on the assembly and requires less power to drive the assembly through the macadam or concrete while also providing greater bit assembly life and requiring less fuel per hour to drive the assembly than heretofore known bit assemblies.

While five differing embodiments of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. In combination, a bit holder and a bit block mountable on one of a drum and continuous chain for use in road milling, trenching and mining equipment, said combination comprising:

a bit holder having a generally frustoconical front portion and a shank rear portion, said generally frustoconical front portion including a flat annular nose surface having an axially extending central bore in communication therewith, a frustoconical segment and a cylindrical base, said shank portion extending axially from said cylindrical base, a bit block including a drum mounting portion and a bit holder mounting portion, said drum mounting portion including a drum mounting surface and a leading forward surface extending at an acute angle from said drum mounting surface, said leading forward surface including an elongate leading ridge and opposed sloping shoulders extending downwardly and outwardly from said leading ridge for efficiently aiding the flow of removed material over and around said bit block drum mounting portion, said bit holder mounting portion extending from said drum mounting portion being generally cylindrical and including a central bore generally perpendicular to said leading ridge for mounting said bit holder therein, a diameter of said generally cylindrical bit holder mounting portion being substantially identical to a diameter of said bit holder cylindrical base for efficient movement of removed material therearound.

2. The combination as defined in claim 1 wherein a downwardly and circumferentially extended edge of each of said opposed shoulders defines a juncture between said drum mounting portion and said generally cylindrical bit holder mounting portion.

3. The combination as defined in claim 2 wherein said outer generally cylindrical surface of said bit holder mounting portion, with the exception of said juncture with said drum mounting portion, is devoid of any protrusions that would impede the flow of removed material thereover.

4. The combination as defined in claim 1 wherein said opposed sloping shoulders extend partway circumferentially around said generally cylindrical bit holder mounting portion for deflecting removed material away from a juncture of said drum mounting portion and said bit holder mounting portion.

* * * * *